US006701883B2

(12) United States Patent
Matsumoto

(10) Patent No.: US 6,701,883 B2
(45) Date of Patent: Mar. 9, 2004

(54) CYLINDER HEAD FOR USE ON A SPARK-IGNITION INTERNAL COMBUSTION ENGINE AND SUCH SPARK-IGNITION INTERNAL COMBUSTION ENGINE

(76) Inventor: Takuya Matsumoto, 228, Kuroda 2-chome, Kanazawa-shi, Kanazawa, Ishikawa (JP), 921-8051

( * ) Notice: Subject to any disclaimer, the term of this patent is extended or adjusted under 35 U.S.C. 154(b) by 0 days.

(21) Appl. No.: 10/391,877

(22) Filed: Mar. 18, 2003

(65) Prior Publication Data

US 2003/0188709 A1 Oct. 9, 2003

(30) Foreign Application Priority Data

Apr. 8, 2002 (JP) ..... 2002-105269

(51) Int. Cl.[7] ..... F02F 1/00
(52) U.S. Cl. ..... 123/193.5; 123/661
(58) Field of Search ..... 123/193.6, 661

(56) References Cited

U.S. PATENT DOCUMENTS 4,191,136 A * 3/1980 Matsumoto ..... 123/193.5
5,105,795 A * 4/1992 Ozawa et al. ..... 123/661
5,211,145 A * 5/1993 Ichikawa et al. ..... 123/661
5,237,972 A * 8/1993 Groff et al. ..... 123/661
5,445,135 A * 8/1995 Feuling ..... 123/193.5
6,237,579 B1 * 5/2001 Singh ..... 123/661

FOREIGN PATENT DOCUMENTS

JP 08-028344 1/1996
JP 10-037749 2/1998

* cited by examiner

*Primary Examiner*—Marguerite McMahon
(74) *Attorney, Agent, or Firm*—Stevens & Showalter LLP

(57) ABSTRACT

A cylinder head and a four-stroke and two-valve spark-ignition internal combustion engine spark-ignition internal combustion engine are provided which allows for enhancing the output and the rotational speed of the engine by increasing the flame propagation rate of the burning air-fuel mixture. As the piston 4 moves up toward the top dead center, the air-fuel mixture within the squish area 14 is inducted along the squish guide groove 15 toward the ignition electrode 7*a* of the ignition plug 7 and is then ignited by the ignition electrode 7*a* when the piston 4 approaches the top dead center. When the mixture is ignited by the ignition electrode 7*a*, there is a flow of the air-fuel mixture around the ignition electrode 7*a* (the ignition plug aperture 12) inducted by the squish guide groove 15 so as to move toward the center of the combustion chamber, so that the flame propagation rate within the combustion chamber may be enhanced as the ignition is effected on such moving air-fuel mixture.

2 Claims, 1 Drawing Sheet

CYLINDER HEAD FOR USE ON A SPARK-IGNITION INTERNAL COMBUSTION ENGINE AND SUCH SPARK-IGNITION INTERNAL COMBUSTION ENGINE

This application claims priority to Japanese Patent Application No. 2002-105269, filed Apr. 8, 2002.

TECHNICAL FIELD

The present invention relates generally to a cylinder head for use on a spark-ignition internal combustion engine with a four-stroke and two-valve system and such spark-ignition internal combustion engine and, more particularly, to such spark-ignition internal combustion engine cylinder head and the spark-ignition internal combustion engine which provide for enhancing the output and the rotational speed of the engine and such spark-ignition internal combustion engine.

BACKGROUND OF THE INVENTION

The four-stroke and two-valve type spark-ignition internal combustion engine typically comprises a cylinder head joined to a cylinder having a piston mounted therein, the cylinder head including a planar squish surface opposing the outer periphery of the top surface of the piston such that a squish area is defined between the squish surface and the piston top surface. The cylinder head is formed in its wall with a combustion chamber recess adjoining the squish surface such that the combustion chamber recess is cooperative with the piston top surface to define a combustion chamber. In addition, the cylinder head has a set of intake and exhaust ports formed open through the wall of the combustion chamber recess at the apex thereof, the intake and exhaust ports being provided with intake and exhaust valves, respectively. An ignition plug aperture is also formed open through the wall of the recess with an ignition plug protruding into the combustion chamber recess.

With the spark-ignition internal combustion engine constructed as described above, as the piston is moved up to a point near its top dead center, the air-fuel mixture is compressed in the squish area defined between the squish surface and the piston top surface whereby there is generated a squish stream swirling in the combustion chamber. The swirling air-fuel mixture moves upwardly in the combustion chamber to be ignited by the ignition plug, and the ignited air-fuel mixture then burns with its flame front propagating in the combustion chamber, so that the piston is moved down toward its bottom dead center by the expansion of the burning air-fuel mixture.

However, in the conventional spark-ignition internal combustion engine described above, both of the squish surface of the cylinder head and the piston top surface which together define the squish area are formed planar and the squish area is located below the projecting lower end of the ignition plug. Due to this arrangement, the squish flow as produced by the squish area may not move directly toward the ignition plug located above squish area, but swirls around in the combustion chamber before it is directed to the vicinity of the ignition plug. Consequently, the squish flow was not capable of guiding an adequate amount of the air-fuel mixture to the vicinity of the ignition plug, and therefore had the disadvantage of being unable to enhance the propagation rate of the flame front of the ignited air-fuel mixture (which will be referred to as flame propagation rate hereinafter. As a result, such prior art construction undesirably led to a decrease in the output and the rotational speed of the internal combustion engine.

BRIEF SUMMARY OF THE INVENTION

In order to overcome the foregoing problems, this invention contemplates to provide a cylinder head for a four-stroke and two-valve spark-ignition internal combustion engine and such spark-ignition internal combustion engine which provides for enhancing the output and the rotational speed of the engine by increasing the flame propagation rate of the ignited and burning air-fuel mixture.

In order to accomplish this object, the cylinder head for a spark-ignition internal combustion engine as set forth in claim 1 is designed to be used on a four-stroke and two-valve spark-ignition internal combustion engine, and is adapted to be joined at mating surfaces to a cylinder having a piston mounted therein. The cylinder head includes a generally planar squish surface opposing the outer peripheral portion of the top surface of the piston; a combustion chamber recess formed in the wall of the cylinder head adjacent the squish surface and defining together with the piston top surface a combustion chamber; a set of intake port and exhaust port formed open through the wall of the combustion chamber recess either at the apex thereof or on the lateral side of the combustion chamber recess opposite from the squish surface; an ignition plug aperture formed open through the wall of the combustion chamber recess at a location closer to the squish surface relative to the intake port and exhaust port and adapted to receive an ignition plug extending therethrough into the combustion chamber; and a squish guide groove formed by notching into the wall of the combustion chamber recess so as to extend from the side of the ignition plug aperture to a location of the squish surface adjacent the inner wall of the cylinder.

The spark-ignition internal combustion engine as set forth in claim 2 is a four-stroke and two-valve type spark-ignition internal combustion engine and comprises a cylinder having a piston mounted therein; a cylinder head adapted to be joined at mating surfaces to the cylinder; a generally planar squish surface formed on the wall of the cylinder head adjacent the mating surfaces and opposing the outer peripheral portion of the top surface of the piston; a combustion chamber recess formed in the wall of the cylinder head adjacent the squish surface and defining together with the piston top surface a combustion chamber; a set of intake valve and exhaust valve disposed on the wall of the combustion chamber recess either at the apex thereof or on the lateral side of the combustion chamber recess opposite from the squish surface; an ignition plug through the wall of the combustion chamber recess into the combustion chamber at a location closer to the squish surface relative to the intake valve and exhaust valve; and a squish guide groove formed by notching into the wall of the combustion chamber recess so as to extend from the side of the ignition plug to a location of the squish surface adjacent the inner wall of the cylinder.

With the spark-ignition internal combustion engine cylinder head or the spark-ignition internal combustion engine according to the present invention, the cylinder head is joined to a cylinder block at mating surfaces. In use, upon the intake port being opened by the intake valve, the piston is lowered toward its bottom dead center as the air-fuel mixture flows into the combustion chamber. When the piston reaches its bottom dead center, the intake port is closed by the intake valve and the piston is moved up toward its top dead center while the air-fuel mixture in the combustion chamber is compressed by the rising piston, whereby squish flow is produced between the outer periphery of the piston top surface and the squish surface with the compression of the air-fuel mixture.

The thus created squish flow ensures adequate mixing of the air and fuel of the air-fuel mixture. The air-fuel mixture is ignited by the ignition plug and begins the combustion during the process while the piston rises toward its top dead center. With the piston rising, the air-fuel mixture over the squish surface is caused to pass around the ignition plug aperture (ignition plug) and flow into the central region of the combustion chamber under the guidance of the squish guide groove and ignition is effected on such flowing air-fuel mixture.

BRIEF DESCRIPTION OF THE DRAWINGS

Other objects, features and advantages will be apparent from the following detailed description of preferred embodiments thereof taken in conjunction with the accompanying drawings in which.

DETAILED DESCRIPTION OF THE EMBODIMENT

Figure 1:
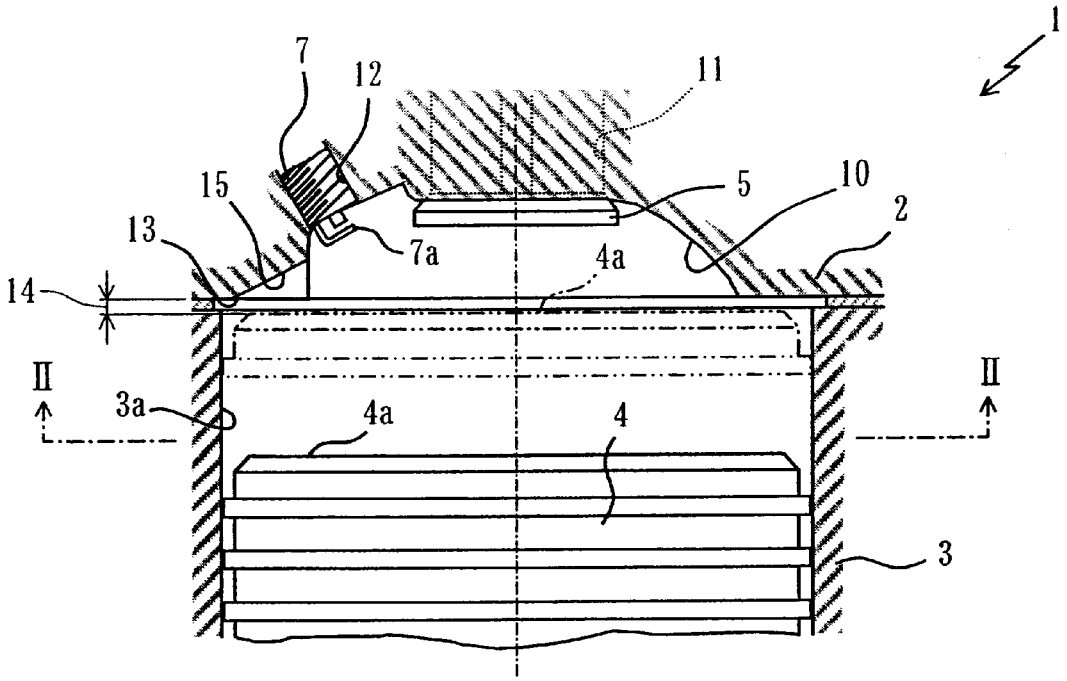
FIG. 1 is a vertical, fragmentary, cross-sectional view illustrating one embodiment of the spark-ignition engine including a cylinder head according to the present invention.
Figure 2:
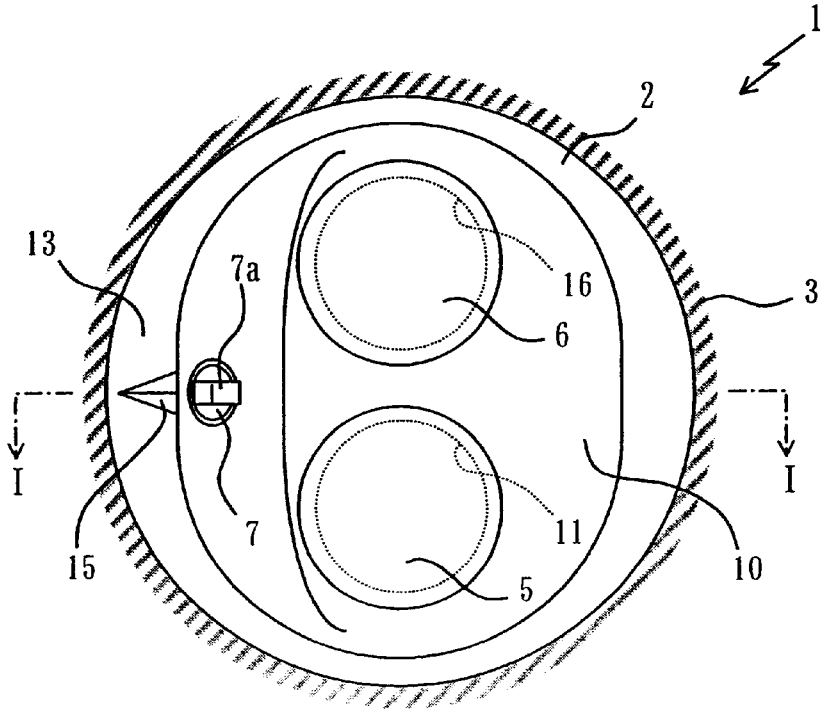
FIG. 2 is a transverse cross-sectional view taken along lines II—II of FIG. 1.

A preferred embodiment of the present invention will be described with reference to the accompanying drawings. FIG. 1 is a vertical cross-sectional view taken along lines I—I of FIG. 2, illustrating a spark-ignition engine 1 including a cylinder head 2 according to one embodiment of the present invention, and FIG. 2 is a transverse cross-sectional view taken along lines II—II of FIG. 1. The spark-ignition engine 1 is a four-stroke and two-valve internal combustion engine of the spark-ignition type, and mainly comprises a cylinder head 2, a cylinder 3, a piston 4 slidably mounted in the cylinder 3, an intake valve 5 for drawing an air-fuel mixture into a combustion chamber, an exhaust valve 6 for discharging combustion gases out of the combustion chamber, and an ignition plug 7 having an ignition electrode 7*a* for igniting the air-fuel mixture, as shown in FIGS. 1 and 2. Here, the air-fuel mixture means a mixed gas of air and fuel.

As shown in FIG. 1, the cylinder head 2 has a combustion chamber recess 10 formed by being recessed upwardly from the surface mating with the cylinder 3. The combustion chamber recess 10, together with the top surface 4*a* of the piston and the inner wall surface 3*a* of the cylinder 3, defines a combustion chamber. Formed open through the wall of the combustion chamber recess 10 at the apex thereof is an intake port 11 which is adapted to be selectively opened and closed by the intake valve 5. An ignition plug aperture 12 is formed open through the wall of the recess 10 on the left-hand side of the intake port 11 as viewed in FIG. 1. The ignition plug 7 is fitted in the ignition plug aperture 12 such that the ignition electrode 7*a* protrudes inwardly into the combustion chamber recess 10.

Further, the cylinder head 2 has a generally planar squish surface 13 formed adjacent the surface mating with the cylinder 3 so as to adjoin the combustion chamber recess 10 and oppose the outer peripheral portion of the piston top surface 4*a*. It is to be noted here that the ignition plug aperture 12 (for the ignition plug 7) is formed through the wall of the recess 10 on the side thereof toward the squish surface 13 such that the ignition electrode 7*a* of the ignition plug 7 is located close to the squish surface 13. In addition, a squish area 14 is defined between the opposing surface portions of the squish surface 13 and the piston top surface 4*a*. The presence of the squish area 14 makes it possible to produce vortices called squish flow in the combustion chamber as the piston 4 rises toward its top dead center (shown in dotted lines in FIG. 1).

Further, the wall of the combustion chamber recess 10 is formed with a squish guide groove 15 downwardly inclined from the side of the ignition plug aperture 12 toward the squish surface 13. More specifically, the squish guide groove 15 is formed by notching into the wall of the combustion chamber recess 10 so as to extend from the side of the ignition plug aperture 12 (the ignition electrode 7*a* of the ignition plug 7) to a location of the squish surface 13 adjacent the inner wall 3*a* of the cylinder. Through this squish guide groove 15 communication is established between the squish area 14 and the space in the vicinity of the ignition electrode 7*a*.

As shown in FIG. 2, the wall of the combustion chamber recess 10 is also provided at the apex thereof with the exhaust valve 6 adapted to selectively open and close an exhaust port 16, in addition to the intake valve 5. The squish guide groove 15 extends generally straight from the squish surface 13 formed on the side of the ignition plug aperture 12 (the ignition plug 7) of the combustion chamber recess 10 toward the ignition plug aperture 12 (the ignition electrode 7*a* of the ignition plug 7) and is notched into the wall of the recess 10 so as to have a cross-sectional shape of V recessed forwardly of the drawing plane of FIG. 2. It is thus to be appreciated that the squish guide groove 15 may be formed by making a very small notch in that peripheral portion of the wall of the combustion chamber recess 10 which is so located that the distance between the ignition plug aperture 12 (the ignition electrode 7*a* of the ignition plug 7) and the squish surface 13 is the shortest, so that an increase in the manufacturing cost of the engine 1 involved with the processing of the squish guide groove 15 may be held down.

The operation of the spark-ignition internal combustion engine 1 will now be described. When the piston 4 reaches the top dead center (the position shown in dotted lines in FIG. 1), the suction stroke starts with the intake port 11 being opened by the intake valve 5 whereupon the piston 4 begins to be lowered to allow the air-fuel mixture to flow into the combustion chamber recess 10. Upon the piston 4 reaching the bottom dead center, the intake port 11 is closed by the intake valve 5 whereupon the cycle moves to the compression stroke during which the piston 4 is raised from the bottom dead center toward the top dead center whereby the air-fuel mixture within the combustion chamber is compressed between the piston top surface 4*a* and the combustion chamber recess 10 while the air-fuel mixture within the squish area 14 is also compressed and swirled in the form of a squish stream within the combustion chamber as the piston 4 rises to thereby promote the mixing of the fuel and the air.

As the piston 4 moves up toward the top dead center, some of the air-fuel mixture within the squish area 14 is inducted (guided) along the squish guide groove 15 toward the ignition electrode 7*a* of the ignition plug 7 and is then ignited by the ignition electrode 7*a* when the piston 4 approaches the top dead center. It is to be appreciated that when the mixture is ignited by the ignition electrode 7*a*, there is a flow of the air-fuel mixture around the ignition electrode 7*a* (the ignition plug aperture 12) inducted by the squish guide groove 15 so as to move toward the center of the combustion chamber, so that the flame propagation rate (speed) within the combustion chamber may be enhanced as the ignition is effected on such moving air-fuel mixture.

Assuming that the conditions except the timing of ignition by the ignition plug 7 are the same, it will be appreciated that an increase in the flame propagation rate allows for correspondingly delaying the timing of ignition by the ignition plug 7, so that the ignition may be effected in a position where the piston 4 is moved closer to its top dead center while the occurrence of knocking due to the delay in the ignition timing may also be prevented. If the timing of ignition by the ignition plug 7 is delayed while the knocking is prevented in this manner, it is possible to enhanoe the compression ratio of the air-fuel mixture within the combustion chamber to thereby increase the output and the rotational speed of the engine 1.

After the ignition is effected by the ignition electrode 7*a*, the piston 4 reaches the top dead center whereupon the cycle moves from the compression stroke to the expansion stroke. During the expansion stroke, the burning air-fuel mixture expands as the piston 4 lowers toward its bottom dead center. Then, upon the piston 4 reaching its bottom dead center, the cycle moves to the exhaust stroke, during which the piston 4 again starts rising toward its top dead center while the exhaust port 16 is opened by the exhaust valve 6 to discharge the combusted air-fuel mixture out of the combustion chamber.

While the present invention has been described with respect to the particular embodiment illustrated herein, it is to be understood by those skilled in the art that various changes, alterations and modifications may be made to the embodiment described above without departing from the spirit and scope of the invention.

For instance, while in the illustrated embodiment the intake port 11 and the exhaust port 16 are shown as being formed open through the wall of the combustion chamber recess 10 at the apex thereof and the intake valve 5 and exhaust valve S for selectively opening and closing the intake port 11 and the exhaust port 16, respectively, are disposed at the apex of the combustion chamber recess 10, the locations of where these intake and exhaust ports are to be formed and the intake and exhaust valves are to be disposed are not limited to the apex of the combustion chamber recess 10, but may be on the lateral side of the combustion chamber recess opposite from the side where the ignition plug aperture 12 (squish surface 13) is located. Further, while in the illustrated embodiment the present invention has been described with respect to the case where a bathtub type combustion chamber is employed as the combustion chamber, this invention is not limited to the use of such type or combustion chamber, but it is to be understood that the Invention is applicable to any spark-ignition engine in which other types of combustion chambers such as the multiple-sphere type, wedge type, etc. are used.

In the cylinder head for use on a spark-ignition internal combustion engine and in the spark-ignition internal combustion engine constructed according to this invention, the squish guide groove is formed in the wall of the combustion chamber recess so as to extend from the side of the ignition plug to a location adjacent the inner wall of the cylinder. This squish guide groove communicates the squish area defined between the squish surface and the piston top surface with the combustion chamber to thereby direct the squish flow produced in the squish area toward the ignition plug aperture (ignition plug). It is thus to be appreciated that there is produced a flow of air-fuel mixture around the ignition plug as directed by the squish guide groove so as to move toward the center of the combustion chamber at the time when the ignition plug is activated as the piston rises to its top dead center, so that the flame propagation rate within the combustion chamber may be advantageously enhanced since the ignition is effected on such flow of air-fuel mixture.

What is claimed is:

1. A cylinder head for use on a four-stroke and two-valve type spark-ignition internal combustion engine, said cylinder head being adapted to be joined at mating surfaces to a cylinder having a piston mounted therein, said cylinder head including:

a generally planar squish surface opposing the outer peripheral portion of the top surface of said piston;

a combustion chamber recess formed in the wall of said cylinder head adjacent said squish surface and defining together with said piston top surface a combustion chamber;

a set of intake port and exhaust port formed open through the wall of the combustion chamber recess either at the apex thereof or on the lateral side of the combustion chamber recess opposite from said squish surface;

an ignition plug aperture formed open through the wall of the combustion chamber recess at a location closer to said squish surface relative to said intake port and exhaust port and adapted to receive an ignition plug extending therethrough into said combustion chamber; and a squish guide groove formed by notching into the wall of the combustion chamber recess so as to extend from the side of said ignition plug aperture to a location of said squish surface adjacent the inner wall of said cylinder, wherein a gap formed between said squish guide groove and the top surface of said piston, when said piston reaches the top dead central region of a compression stroke, is relatively large as compared to the squish area between the opposing squish surface and the top surface of said piston, and is progressively larger toward said ignition plug, so that the compressive pressure on the air-fuel mixture in the squish guide groove decreases progressively as it goes from the outer periphery of the squish area toward said ignition plug.

2. A four-stroke and two-valve type spark-ignition internal combustion engine, comprising;

a cylinder having a piston mounted therein;

a cylinder head adapted to be joined at mating surfaces to said cylinder;

a generally planar squish surface formed on the wall of said cylinder head adjacent the mating surfaces and opposing the outer peripheral portion of the top surface of said piston;

a combustion chamber recess formed in the wall of said cylinder head adjacent said squish surface and defining together with said piston top surface a combustion chamber;

a set of intake valve and exhaust valve disposed on the wall of the combustion chamber recess either at the apex thereof or on the lateral side of the combustion chamber recess opposite from said squish surface;

an ignition plug through the wall of the combustion chamber recess into said combustion chamber at a location closer to said squish surface relative to said intake valve and exhaust valve; and a squish guide groove formed by notching into the wall of the combustion chamber recess so as to extend from the side of said ignition plug to a location of said squish surface adjacent the inner wall of said cylinder, wherein a gap formed between said squish guide groove and the top surface of said piston, when said piston reaches the top dead central region of a compression stroke, is relatively large as compared to the squish area between the opposing squish surface and the top surface of said piston, and is progressively larger toward said ignition plug, so that the compressive pressure on the air-fuel mixture in the squish guide groove decreases progressively as it goes from the outer periphery of the squish area toward said ignition plug.

* * * * *